US005080628A

United States Patent [19]

Tate

[11] Patent Number: 5,080,628

[45] Date of Patent: Jan. 14, 1992

[54] TOY ROLLER COASTER APPARATUS

[76] Inventor: William R. Tate, 500 NE Blackie Rd., Claremore, Okla. 74017

[21] Appl. No.: 619,398

[22] Filed: Nov. 29, 1990

[51] Int. Cl.[5] ..... A63H 19/00

[52] U.S. Cl. ..... 446/445; 446/431

[58] Field of Search ..... 446/228, 236, 237, 238, 446/240, 431, 444, 445, 446, 447, 465, 467, 470; 104/DIG. 1; 213/75 TC

[56] References Cited

U.S. PATENT DOCUMENTS

| | | | |
|---|---|---|---|
| 482,957 | 9/1892 | Allen | 446/444 X |
| 719,200 | 1/1903 | Dean | 446/444 |
| 2,500,180 | 3/1950 | Hubbell | 213/75 TC |
| 2,789,391 | 4/1957 | Perry | 446/446 X |
| 2,939,245 | 6/1960 | Orel | 446/467 X |
| 3,562,950 | 2/1971 | Genin | 446/236 |
| 4,034,678 | 7/1977 | Wilson | 496/446 |
| 4,219,123 | 8/1980 | Saeki | 213/75 TC |
| 4,568,305 | 2/1986 | De Anda et al. | 446/447 X |

FOREIGN PATENT DOCUMENTS

| | | | |
|---|---|---|---|
| 829871 | 11/1952 | Fed. Rep. of Germany | 446/444 |

*Primary Examiner*—Robert A. Hafer
*Attorney, Agent, or Firm*—Leon Gilden

[57] ABSTRACT

An apparatus wherein a single, continuous track includes a plurality of elevators associated with hill portions of the track. The track further includes a plurality of loops and a housing structure to effect visual enhancement in use of the organization. The vehicles utilized in the apparatus each include plural pairs of wheel sets, with each wheel set positioned above and below orthogonally a single track rail of a plurality of parallel rails defining the track. Coupling means include vertical and horizontally pivotal portions to permit both vertical and horizontal pivotment of the vehicles relative to one another in their traverse about the track.

4 Claims, 4 Drawing Sheets

TOY ROLLER COASTER APPARATUS

BACKGROUND OF THE INVENTION

1. Field of the Invention

The field of invention relates to toy vehicle apparatus, and more particularly pertains to a new and improved toy roller coaster apparatus wherein the same provides for a series of coupled vehicles traversing a single defined track.

2. Description of the Prior Art

Toy apparatus utilizing vehicles directed about a track is well known in the prior art. Examples of such may be found in U.S. Pat. No. 4,221,076 to Ozawa wherein a toy vehicle utilizes a race track employing various obstacles and impediments in the path of the vehicle.

U.S. Pat. No. 3,613,304 to Einfalt sets forth an additional example of a toy track utilizing a train arrangement directed thereover.

U.S. Pat. No. 4,068,402 to Tanaka; U.S. Pat. No. 3,699,711 to Coffey, Sr.; and U.S. Pat. No. 4,571,204 to Wang are all further examples of vehicles directed about a track arrangement.

As such, it may be appreciated that there continues to be a need for a new and improved toy roller coaster apparatus as set forth by the instant invention wherein the organization utilizes a single track arrangement including various impediments mounting the vehicles thereon in an arrangement to permit their pivotment and motion about the track in a stable interrelationship.

SUMMARY OF THE INVENTION

In view of the foregoing disadvantages inherent in the known types of toy track apparatus now present in the prior art, the present invention provides a toy roller coaster apparatus wherein the same utilizes a single track mounting a procession of vehicles coupled together permitting pivotal movement in vertical and horizontal planes arranged orthogonally relative to one another. As such, the general purpose of the present invention, which will be described subsequently in greater detail, is to provide a new and improved toy roller coaster apparatus which has all the advantages of the prior art toy vehicle and track apparatus and none of the disadvantages.

To attain this, the present invention provides an apparatus wherein a single, continuous track includes a plurality of elevators associated with hill portions of the track. The track further includes a plurality of loops and a housing structure to effect visual enhancement in use of the organization. The vehicles utilized in the apparatus each include plural pairs of wheel sets, with each wheel set positioned above and below orthogonally a single track rail of a plurality of parallel rails defining the track. Coupling means include vertical and horizontally pivotal portions to permit both vertical and horizontal pivotment of the vehicles relative to one another in their traverse about the track.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy roller coaster apparatus which has all the advantages of the prior art toy vehicle and track apparatus and none of the disadvantages.

It is another object of the present invention to provide a new and improved toy roller coaster apparatus which may be easily and efficiently manufactured and marketed.

It is a further object of the present invention to provide a new and improved toy roller coaster apparatus which is of a durable and reliable construction.

An even further object of the present invention is to provide a new and improved toy roller coaster apparatus which is susceptible of a low cost of manufacture with regard to both materials and labor, and which accordingly is then susceptible of low prices of sale to the consuming public, thereby making such toy roller coaster apparatus economically available to the buying public.

Still yet another object of the present invention is to provide a new and improved toy roller coaster apparatus which provides in the apparatuses and methods of the prior art some of the advantages thereof, while simultaneously overcoming some of the disadvantages normally associated therewith.

Still another object of the present invention is to provide a new and improved toy roller coaster apparatus wherein the same utilizes a coupling relationship between the vehicles and the vehicles and track to maintain mounting of the vehicles to the track and permitting uphill motion in a plurality of planes relative to the track by the vehicles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
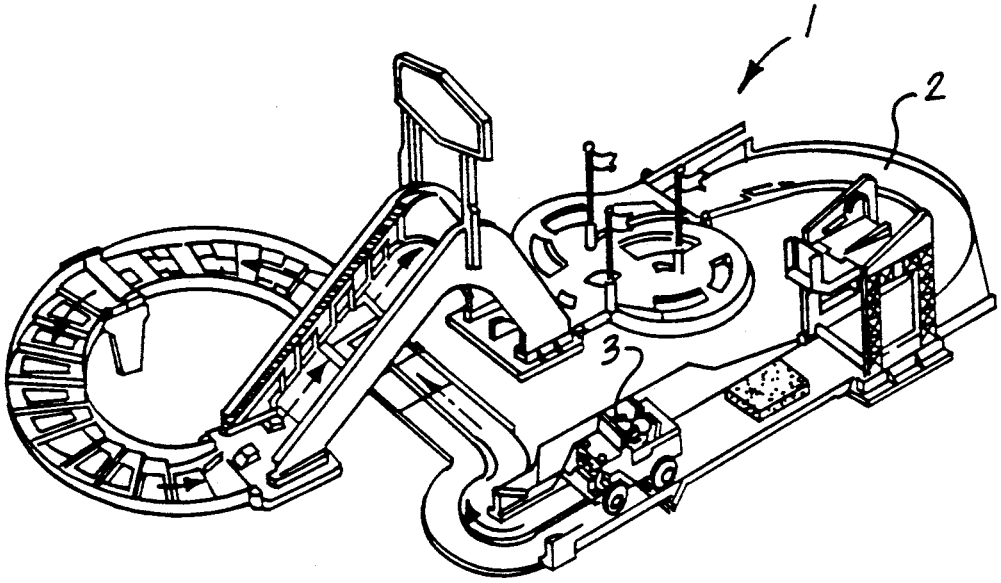
FIG. 1 is an isometric illustration of a prior art toy vehicle and track apparatus.
Figure 2:
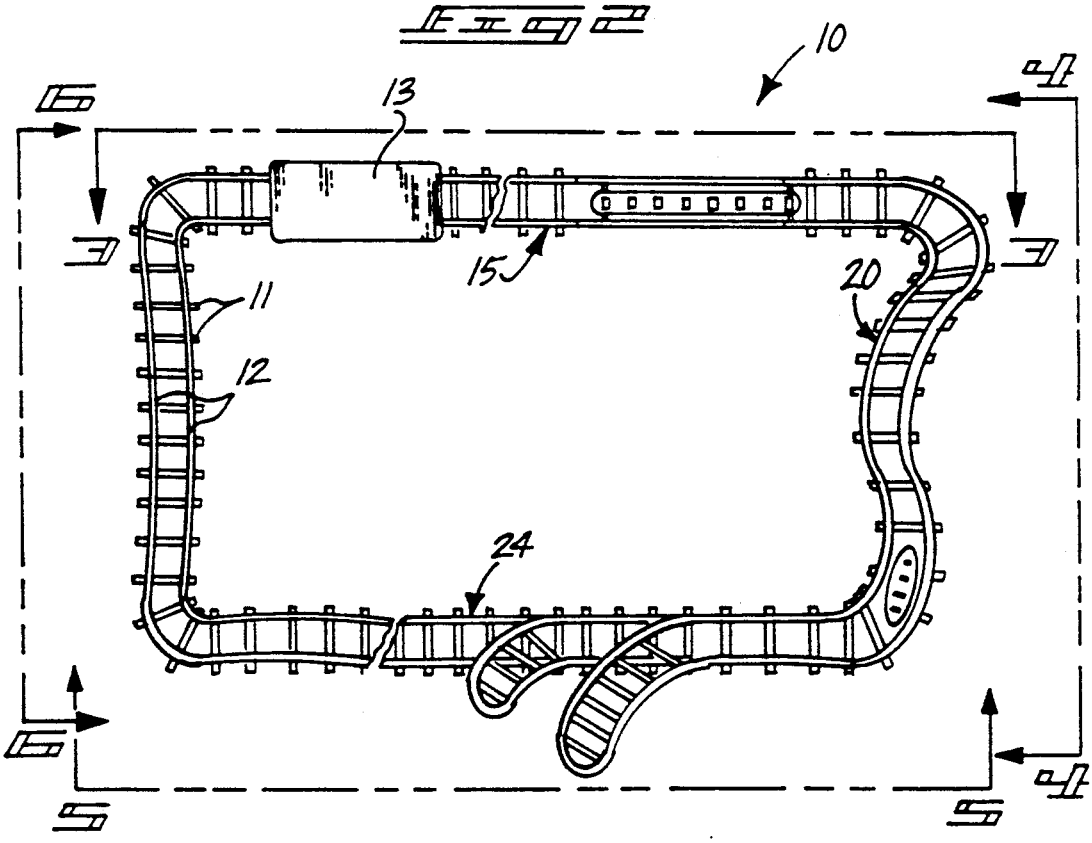
PRIOR ART FIG 2
FIG. 2 is a top orthographic view of the track arrangement of the instant invention.
Figure 3:
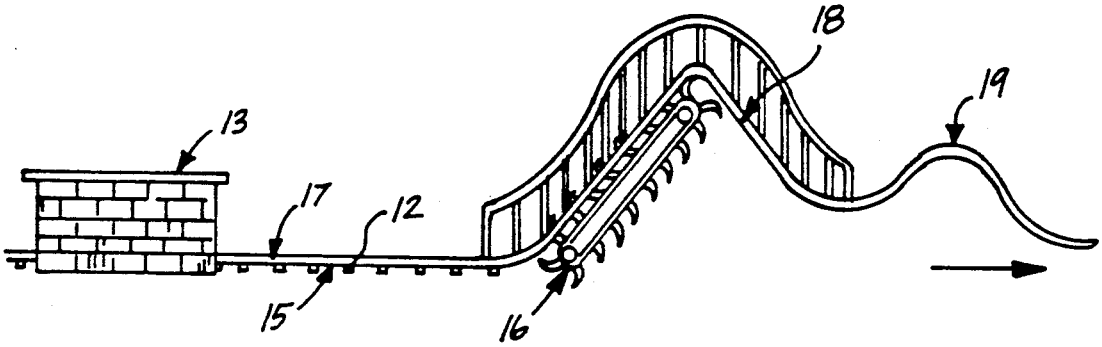
FIG. 3 is an orthographic view, taken along the lines 3—3 of FIG. 2 in the direction indicated by the arrows.
Figure 4:
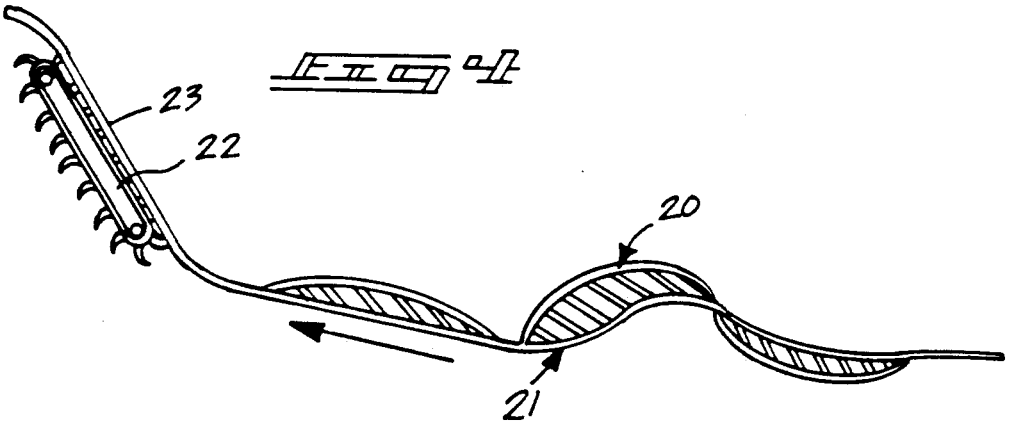
FIG. 4 is an orthographic view, taken along the lines 4—4 of FIG. 2 in the direction indicated by the arrows.
Figure 5:
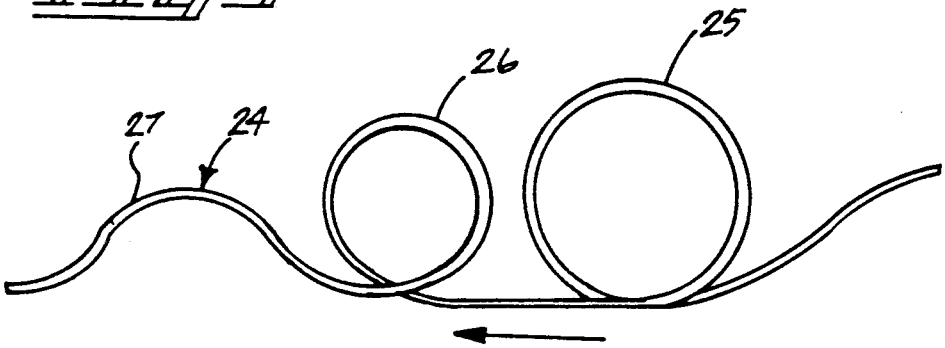
FIG. 5 is an orthographic view, taken along the lines 5—5 of FIG. 2 in the direction indicated by the arrows.
Figure 6:
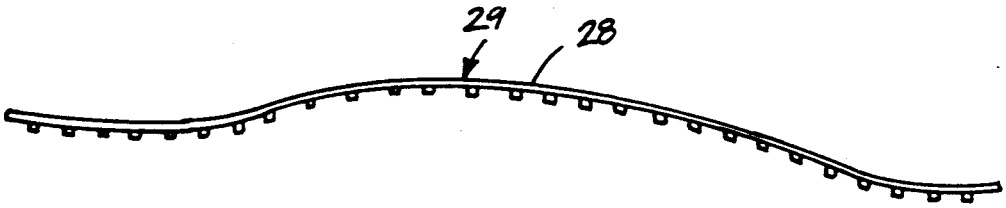
FIG. 6 is an orthographic view, taken along the lines 6—6 of FIG. 2 in the direction indicated by the arrows.

With reference now to the drawings, and in particular to FIGS. 1 to 10 thereof, a new and improved toy roller coaster apparatus embodying the principles and concepts of the present invention and generally designated by the reference numeral 10 will be described.

FIG. 1 illustrates a prior art toy track and vehicle apparatus 1, wherein a track 2 utilizes a vehicle 3 directed about the track to overcome a series of obstacles positioned thereon, as set forth in U.S. Pat. No. 4,221,076.

More specifically, the toy roller coaster apparatus 10 of the instant invention essentially comprises a single, continuous track member including a first track section 15, a second track section 20, a third track section 24, and a fourth track section 29. The track sections each comprise a plurality of parallel track members 12 of a cylindrical, cross-sectional configuration. Support rails 11 of a generally "C" shaped configuration (see FIG. 8) extend diametrically outwardly of and below each of the track members. The first track section 15 includes a starting housing 13 defined by a predetermined first length to house a plurality of vehicles 14 whose individual total length equals a second length less than the first length to contain the plurality of vehicles 14 within the housing 13 initiating utilization of the organization. The first track section 15 further includes a first elevator 16 (see FIG. 3), wherein the first elevator 16 includes a toothed endless conveyor member to receive and direct the plurality of vehicles upwardly of a first hill track portion 18. A first straight track portion 17 is positioned between the starting housing 13 and the first elevator 16. A second hill track portion 19 of a lesser height is positioned forwardly of the first hill track portion 18. The second track portion 20 includes a first serpentine section 21 directing to a third hill track section 23 utilizing a second elevator 22, also of a toothed endless conveyor construction. It should be noted that the spaced toothed portions of each endless conveyor are spaced apart a distance substantially equal to spaced parallel axles 33 utilized underlying each of the vehicles with a plurality of vehicles 14. The third track section 24 includes a first track loop 25 and a second track loop 26 extending through a fourth hill 27. The fourth track section 29 utilizes a fifth hill 28 extending into the first track section 15.

Figure 7:
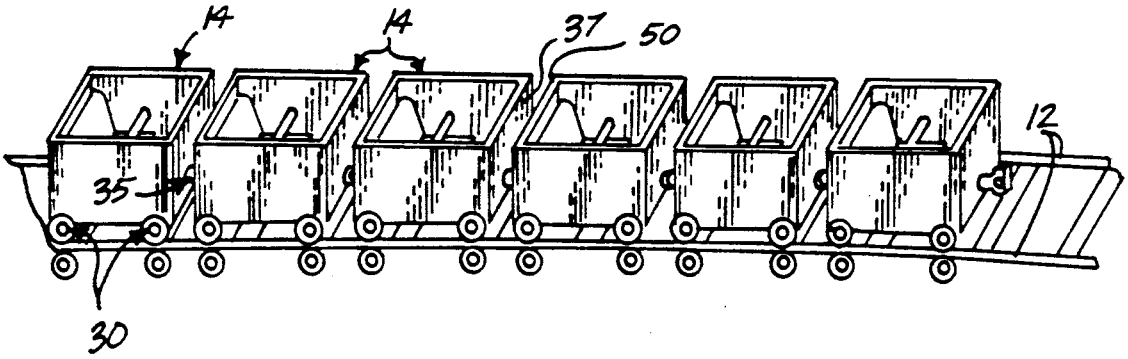
FIG. 7 is an isometric illustration of the vehicles utilized by the instant invention.
Figure 8:
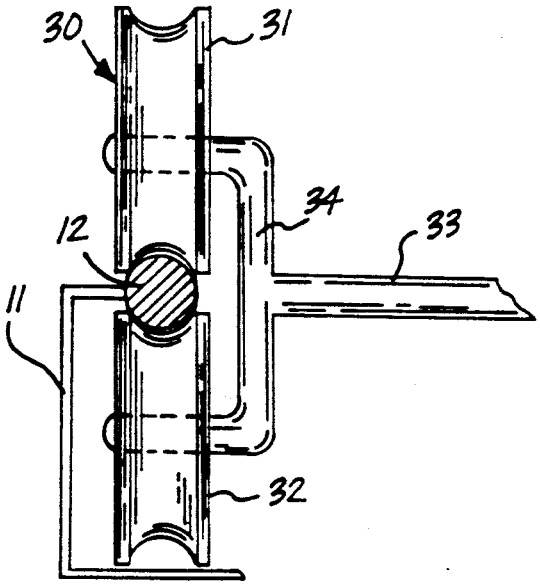
FIG. 8 is an orthographic cross-sectional illustration of a vehicle wheel set of a plurality of wheel sets utilized by each vehicle.
Figure 9:
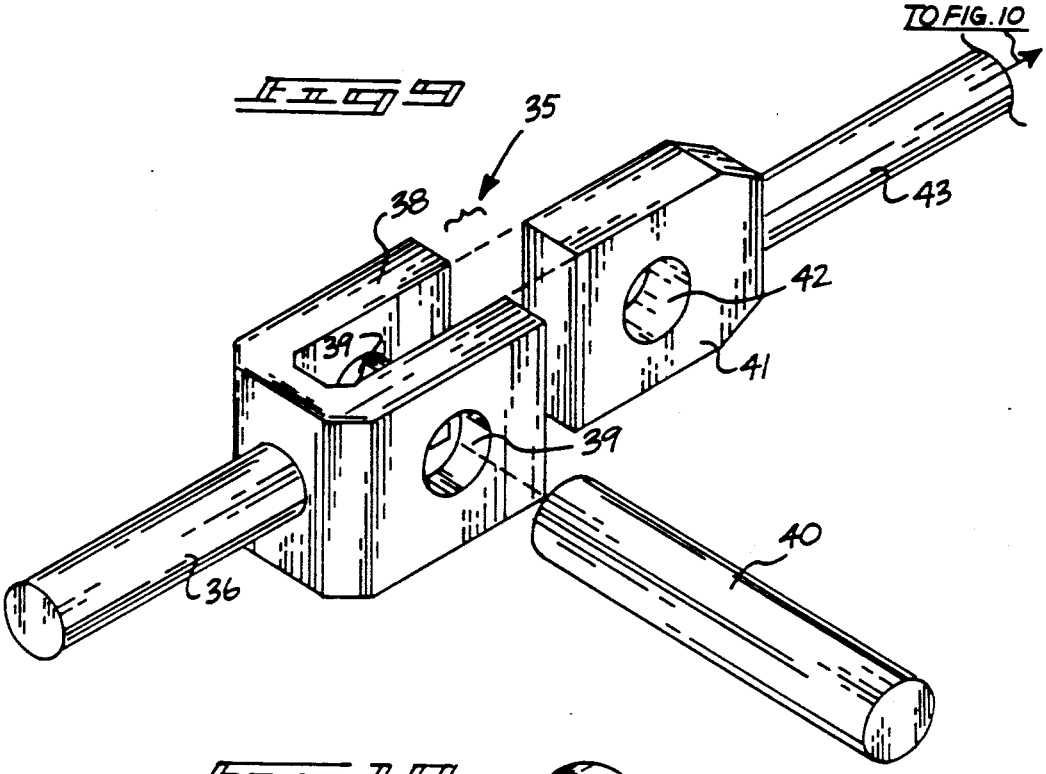
FIG. 9 is an isometric illustration of a portion of the coupling utilized between each vehicle.
Figure 10:
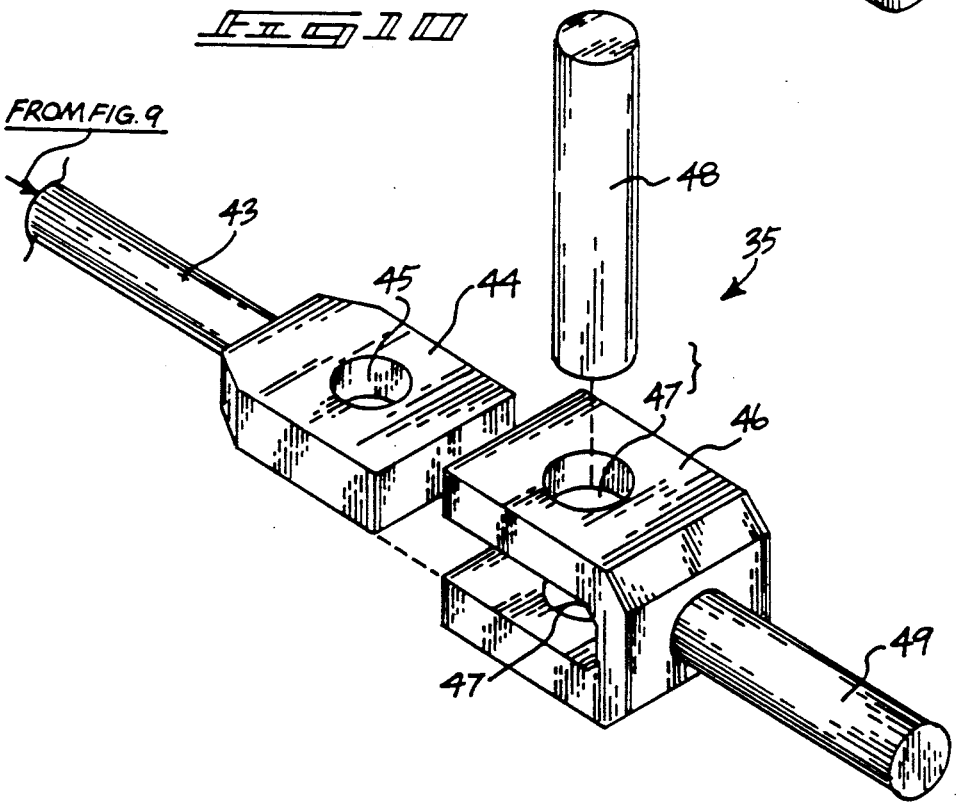
FIG. 10 is an isometric illustration of the vehicle coupling utilized in conjunction with the coupling as illustrated in FIG. 9.

Each vehicle of the plurality of vehicles includes a plurality of spaced axles 33, with each of the axles 33 including a "C" shaped wheel set support 34, including upper and lower bars to include an upper and lower wheel 31 and 32 respectively. Each upper and lower wheel 31 and 32 defines a wheel set, with a plurality of wheel sets utilized with each axle and a plurality of axles utilized with each vehicle. Accordingly, forward and rear wheel set pairs 30 are utilized by each vehicle, as illustrated in FIG. 7.

A coupling 35 is positioned between a forward vehicle wall 37 and a rear vehicle wall 50 of each vehicle. The coupling 35 (see FIGS. 9 and 10) includes a first bar 36 fixedly and orthogonally mounted to the forward vehicle wall 37. The first bar 36 extends into a first "C" shaped coupling 38, including coaxially aligned first bore pairs 39. The first bore pairs 39 are horizontally aligned to receive a first pin 40, with a first coupling block 41 received within the first "C" shaped coupling 38, with the first coupling block 41 including a second bore 42, whereupon directing of the first pin 40 through the second bore 42 and the first bore pairs 39 secures a second bar 43 to the first bar 36 permitting pivotment between the first and second bars in a vertical plane. The second bar 43 extends forwardly and terminates in a second coupling block 44 horizontally aligned with a third bore 45 orthogonally directed through the second coupling block 44. A second "C" shaped coupling 46 receives the second coupling block 44, with the second "C" shaped coupling 46 including fourth bore pairs 47 that are coaxially aligned to receive a second pin 48 between the fourth bore pairs 47 and the third bore 45 to permit pivotment of the second bar 43 relative to a third bar 49 in a horizontal plane. The third bar 49 is fixedly and orthogonally mounted to the rear vehicle wall 50. The couplings 35 are repeated between each adjacent pair of vehicles, as illustrated in FIG. 7 for example.

It should be understood that motivation for the elevator members 16 and 22 may be effected by utilization of conventional electric drive members (not shown), as well as the organization utilizing electrical lighting and the light for enhanced visual effect, if desired.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toy roller coaster apparatus comprising, a continuous track, the track including a plurality of parallel track members, the track members including spaced support rails extending outwardly of and underlying the track members, and a plurality of vehicles mounted on the track members, and coupling means mounted between adjacent vehicles for permitting vertical and horizontal pivotment of the adjacent vehicles, and wherein the track members are each of a cylindrical cross-sectional configuration, and wherein each of the plurality of vehicles includes a plurality of parallel axles, and each axle includes a wheel pair mounted at each terminal end of the axle, and each wheel pair encompassing track member therebetween.

2. A toy roller coaster apparatus as set forth in claim 1 wherein each axle includes a "C" shaped wheel set support mounted at each terminal end of each axle, the "C" shaped wheel set support includes an upper and lower bar extending above and below a respective track member, and each upper and lower bar includes a wheel mounted rotatably thereon.

3. A toy roller coaster apparatus as set forth in claim 2 wherein each support rail is fixedly mounted diametrically relative to each track member and extends exteriorly thereof and extends below each track member and below an upper and lower wheel defining each wheel pair, with each wheel pair mounted to a respective "C" shaped wheel set support of each of the "C" shaped wheel set supports mounted at each terminal end of each axle.

4. A toy roller coaster apparatus as set forth in claim 3 wherein each vehicle of the plurality of vehicles includes a forward vehicle wall and a rear vehicle wall, the forward vehicle wall includes a first bar fixedly and orthogonally mounted thereto, the first bar including a first "C" shaped coupling fixedly mounted to a forward terminal end of each first bar, the first "C" shaped coupling includes a coaxially aligned first bore pair, the first bore pair horizontally aligned and arranged parallel relative to each axle, and a first coupling block received within each first "C" shaped coupling, the first coupling block including a second bore, the second bore and the first bore pair coaxially aligned, and a first pin extending through the first bore pair and the second bore to pivotally mount the first coupling block to the first "C" shaped coupling in a vertical plane, and the first coupling block including a second bar fixedly mounted thereto, with the second bar extending forwardly of the first coupling block, and the second bar including a second coupling block mounted at a forward terminal end of the second bar remote from the first coupling block, and the second coupling block including a third bore directed orthogonally and vertically through the second coupling block, and a second "C" shaped coupling slidably receiving the second coupling block therewithin, and the second "C" shaped coupling including a plurality of fourth bores defining a fourth bore pair, with the fourth bore pair coaxially aligned relative to each other and the third bore, and a second pin directed through the fourth bore pair and the third bore to permit pivotment of the second coupling block relative to the second "C" shaped coupling in a horizontal plane, and the second "C" shaped coupling including a third bar extending forwardly of the second "C" shaped coupling, and the third bar fixedly and orthogonally mounted to the rear vehicle wall of each vehicle of the plurality of vehicles.

* * * * *